United States Patent [19]

Neumüller et al.

[11] Patent Number: 4,735,557

[45] Date of Patent: Apr. 5, 1988

[54] PUMP FOR CONVEYING A VISCOUS MEDIUM

[76] Inventors: Walter Neumüller, Haupstrasse 71, A-2542 Mannersdorf/Lbg., Austria; Gerhard Sturmer, Rosentalerstrasse 46, A-9020 Klagenfurt, Austria

[21] Appl. No.: 850,277

[22] Filed: Apr. 10, 1986

[30] Foreign Application Priority Data

| | | | |
|---|---|---|---|
| Apr. 17, 1985 | [AT] | Austria | 1160/85 |
| Aug. 7, 1985 | [AT] | Austria | 2312/85 |
| Feb. 10, 1986 | [AT] | Austria | 324/86 |

[51] Int. Cl.[4] ..... I04B 43/12

[52] U.S. Cl. ..... 417/477

[58] Field of Search ..... 417/476, 477, 363

[56] References Cited

U.S. PATENT DOCUMENTS

| | | | |
|---|---|---|---|
| 2,002,862 | 5/1935 | Moran | 417/476 |
| 2,466,618 | 4/1949 | Stocks | 417/477 |
| 2,898,864 | 8/1959 | Japolsky | 417/477 X |
| 2,899,905 | 8/1959 | Becher | 417/477 |
| 3,431,864 | 3/1969 | Jones | 417/477 X |
| 3,712,762 | 1/1973 | Kenney | 417/477 |

*Primary Examiner*—Carlton R. Croyle
*Assistant Examiner*—T. Olds
*Attorney, Agent, or Firm*—Kurt Kelman

[57] ABSTRACT

A pump for conveying a viscous medium, comprising a feed hose in the pump housing, a support wall extending along the feed hose and supporting the feed hose in the housing, pressure rolls mounted for movement along the feed hose diametrically opposite the support wall and arranged to compress the feed hose between the support wall and a respective pressure roll as the pressure roll moves along the feed hose whereby the feed hose is successively deformed from a normal, expanded shape to a compressed, flattened shape and the viscous medium therein is conveyed from a suction to the output end of the feed hose, and a centering device engaging the feed hose at its periphery for holding the feed hose in alignment with the support wall and for returning the feed hose from the compressed to the normal shape after the pressure roll has passed, the centering device including resiliently yielding support elements mounted in the housing and arranged at both sides of the feed hose, the support wall and the pressure roll diametrically opposed to each other and exerting a radial thrust against the feed hose in a plane defined by the feed hose in the compressed, flattened shape, the support elements being yieldingly retracted by the flattened feed hose as it is compressed by the passing pressure roll into the flattened shape.

6 Claims, 1 Drawing Sheet

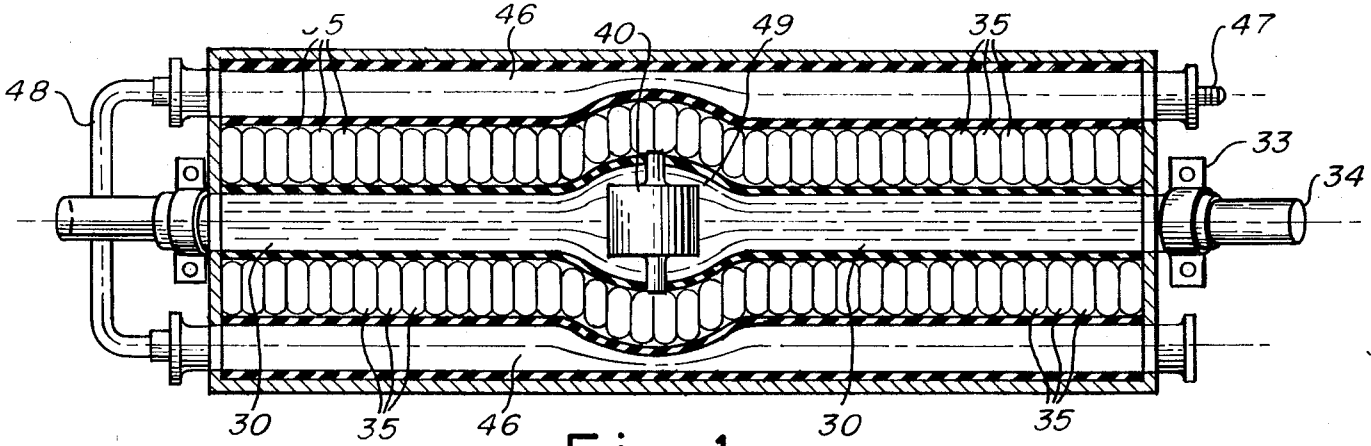
Fig. 1.
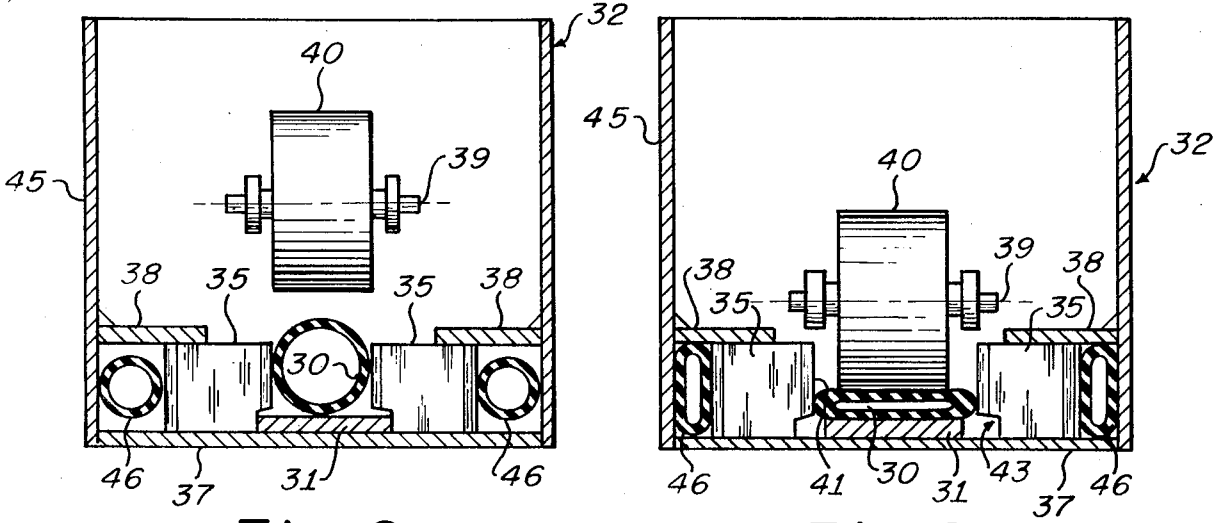
Fig. 3.
Fig. 2.
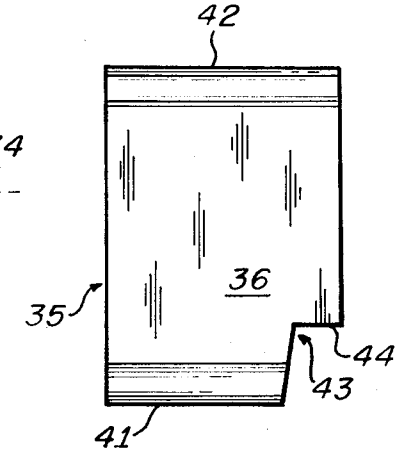
Fig. 4.
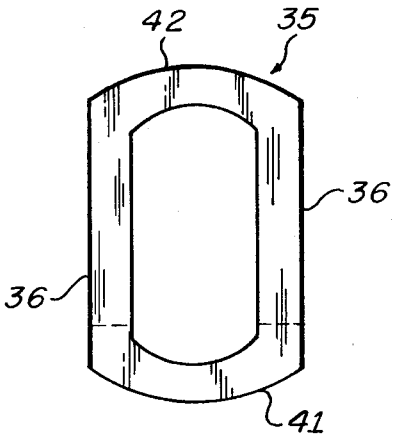
Fig. 5.

PUMP FOR CONVEYING A VISCOUS MEDIUM

The present invention relates to a pump for conveying a viscous medium, such as concrete or mortar mixtures, which comprises a housing, a feed hose in the housing for conveying the viscous medium from a suction end thereof to an output end, a support wall extending along the feed hose and suppoting the feed hose in the housing between the ends thereof, pressure rolls mounted for movement along the feed hose diametrically opposite the support wall and arranged to compress the feed hose between the support wall and a respective pressure roll as the pressure roll moves along the feed hose whereby the feed hose is successively deformed from a normal, expanded shape to a compressed, flattened shape and the viscous medium therein is conveyed from a suction to the output end of the feed hose, and a centering device engaging the feed hose at its periphery for holding the feed hose in alignment with the support wall and for returning the feed hose from the comprssed to the normal shape after the pressure roll has passed.

A pump of this type has been disclosed in German Pat. No. 1,203,137. This pump comprises a cylindrical housing having a suction end and an output end. A rotor in the housing carries a plurality of equidistantly spaced pressure rolls for compressing the feed hose against the wall of the housing which serves as a suppot wall for the feed hose. Two diametrically opposite support rollers are arranged in the direction of rotation of the rotor behind the pressure rolls, the spacing between the support rollers corresponding to the diameter of the feed hose. These support rollers serve the purpose of returning the feed hose which has just been compressed by a pressure roll into a flattened shape to its normal, expanded shape. Considering the fact that the rotors of such pumps operate at about 60 rpm and that the feed hoses have a very slow conveying motion, this structure does not assure that the support rollers spaced a very short distance behind the pressure rolls will actually engage the sides of the flattened feed hose but, more often, will damage the feed hose and tear it at its sides. This happens, in particular, because the feed hose is almost inert after it has been compressed because of the prevailing vacuum therein and, therefore, expands only very slowly. It is another disadvantage of this structure that the feed hose is not readily accessible for repairs or replacement.

It is a primary object of this invention to avoid the indicated disadvantages in a pump of the first-described type and to obtain a satisfactory feeding velocity while protecting the feed hose against damage.

The above and other objects are accomplished according to the invention with a centering device which includes resiliently yielding support elements mounted in the housing and arranged at both sides of the feed hose, the support wall and the pressure roll diametrically opposed to each other and exerting a radial thrust against the feed hose in a plane defined by the feed hose in the compressed, flattened shape, the support elements being yieldingly retracted by the flattened feed hose as it is compressed by the passing pressure roll into the flattened shape.

Such support elements can be so constructed that they properly engage the feedhose in its flattened shape to restore it to the expanded shape after it has been compressed by the passing pressure roll, independently of the velocity with which the pressure rolls move along the feed hose. This has the advantage that the feed hose is dependenly restored to its cylindrical shape without damage thereto. The restoring force of the support elements is generated by the force stored therein when they are resiliently retracted by the flattened feed hose as it is compressed by the passing pressure roll into the flattened shape.

The above and other objects, advantages and features of the present invention will become more apparent from the following detailed description of certain now preferred embodiments thereof, taken in conjunction with the accompanying, somewhat schematic drawing wherein FIG. 1 is a top view showing the feed hose, the support wall, the pressure roll and the centering device in cooperation according to this invention;

FIGS. 2 and 3 are end views of the embodiment of FIG. 1, FIG. 2 showing the feed hose in its normal, expanded shape and FIG. 3 showing the feed hose in its compressed, flattened shape;

FIGS. 4 and 5 are, respectively, side and end views of the support elements of the embodiment of FIG. 1.

Referring now to the drawing there is shown a pump for conveying a viscous medium, such as a concrete mixture or mortar. The pump comprises housing 32 and rectilinearly extending feed hose 30 in support wall 31 arranged on bottom wall 37 of pump housing 32 extends along feed hose 30 and supports the feed hose in the housing between the ends thereof. Clamps 33 affix the suction and output ends of the feed hose to the pump housing, and one of the clamps also mounts the feed hose output end on steel pipe 34 which conveys the pumped viscous medium to a desired location. Resiliently yielding support elements 35 are arranged at both sides of feed hose 30, support wall 31 and pressure roll 40 diametrically opposed to each other. As shown in FIG. 1, they extend along the entire length of feed hose 30 for engagement therewith and are glidable in a direction parallel to axis 39 of the pressure rolls between bottom wall 37 and top plates 38 which form a guideway for glidable support elements 35. Diametrically oppositely arranged pneumatic hoses 46, 46 extend parallel to feed hose 30 and resiliently exert a radial thrust on the support elements to bias them towards the feed hose. The pneumatic hoses are mounted in the guideways formed by bottom wall 37 and top plates 38 adjacent side walls 45 of pump housing 32. The pneumatic hoses are interconnected at one of their ends by pipe 48 while valve 47 is mounted at an opposite end of one of the pneumatic hoses for supplying air under pressure to the pneumatic hoses. If support elements 35 have a length substantially corresponding to the diameter of feed hose 30 and a width substantially corresponding to the radius of the feed hose, the centering device may be readily adapted to any type of compressed feed hose shape while adequate engagement of the support elements with the periphery of the feed hose is assured and there is a minimum of friction between the gliding support elements to avoid jamming.

As best shown in FIGS. 4 and 5, support elements 35 are parallelepiped and comprise domed support face 41 arranged for engaging the feed hose and opposite domed pressure face 42 receiving pressure biasing the support elements toward feed hose 30, the parallelepiped support elements consisting of two parallel sliding faces 36, 36 extending on the direction of axes 39 of pressure rolls 40 and the domed support and pressure faces 41, 42 connecting the sliding faces. Curving support faces 41 so that they present a convex engagement face with the feed hose avoids sharp-edged engagements with the feed hose and improved conformity to the compressed profile of the feed hose. In addition, the domes shaped of the pressure faces of the support elements assures that they engage the feed hose along their longitudinal center line, thus preventing jamming between the adjacent support elements and reducing friction therebetween as they are resiliently pressed against the feed hose. Also, such ring-shaped support elements are light and, therefore, are displaceable resiliently with little force.

As shown in FIG. 4, the lower portions of sliding faces 36 and support face 41 adjacent thereto define recess 43 in support element 35 and the recess has abutment 44 engaging support wall 31 (see FIGS. 2 and 3) for feed hose 30. In the position of pressure roll 40 shown in FIG. 2, abutments 44 of support elements 35 engage support wall 31 under the radial thrust exerted upon the support elements by pneumatic hoses 46 while leaving feed hose 30 in its normal, expanded shape. In this manner, the feed hose remains centered on support wall 31 and remains in its cylindrical shape without being subjected to stress. Abutments 44 accurately limit the displacement path of the support elements under the radial thrust of pneumatic hoses 46 to assure the centering of the feed hose. Furthermore, the support elements are held thereby under tension in their foremost positions, which is adjustable for different operating parameters dependent primarily on the type of viscous medium being conveyed in the feed hose. When pressure roll 40 compresses feed hose 30 containing a viscous medium to assume a flattened shape 49 (see FIGS. 1 and 3), adjacent support elements will be automatically retracted and their pressure faces 42 will deform pneumatic hoses 46.

Since feed hose 30 glides up and down along pressure faces 41 of support elements 35 as it assumes flattened shape 49 and is then returned to its expanded shape as pressure roll 40 moves on, it will be useful to apply French chalk or any other suitable lubricant to reduce friction between the feed hose and the support elements. While the feed hose has been illustrated as extending in a flat plane, it could also be arranged in an arc and could be compressed by a pressure roll mounted on a rotor. If the feed hose extends arcuately, the support elements must be conically shaped in conformity to the curvature of the arc.

What we claim is:

1. A pump for conveying a viscous medium, comprising (a) a housing, (b) a rectilinearly extending feed hose in the housing for conveying the viscous medium from a suction end thereof to an output end, (c) a support wall extending along the feed hose and supporting the feed hose in the housing between the ends thereof, (d) pressure rolls mounted for movement along the feed hose diametrically opposite the support wall and arranged to compress the feed hose between the support wall and a respective one of the pressure rolls as the pressure roll moves along the feed hose whereby the feed hose is successively deformed from a normal, expanded shape to a compressed, flattened shape and the viscous medium therein is conveyed from the suction to the output end, and (e) a centering device engaging the feed hose at its periphery for holding the feed hose in alignment with the support wall and for returning the feed hose from the compressed to the normal shape after the pressure roll has passed, the centering device including (1) a multiplicity of adjacent resiliently yielding, parallelepiped support elements mounted in the housing and arranged at both sides of the feed hose, said support elements extending along the entire length of the feed hose for engagement therewith and comprising a support face arranged for engaging the feed hose and an opposite pressure face receiving pressure biasing the support elements towards the feed hose, the support and pressure faces of the support elements being domed, the support elements being glidable in a direction parallel to the axes of the pressure rolls and being biased towards the feed hose, the support wall and the pressure roll being diametrically opposed to each other and exerting a radial thrust against the feed hose in a plane defined by the feed hose in the compressed, flattened shape, and the support elements being yieldingly retracted by the flattened feed hose as it is compressed by the passing pressure roll into the flattened shape.

2. The pump of claim 1, wherein the support elements are comprised of synthetic resin.

3. The pump of claim 1, further comprising diametrically oppositely arranged pneumatic hoses extending parallel to the feed hose, the pneumatic hoses resiliently exerting the radial thrust on the support elements.

4. The pump of claim 1, wherein the support elements have a length substantially corresponding to the diameter of the feed hose and a width substantially corresponding to the radius of the feed hose.

5. The pump of claim 1, wherein the parallelepiped support elements consist of two parallel sliding faces extending in the direction of the pressure roll axes and the domed support and pressure faces connecting the sliding faces.

6. The pump of claim 5, wherein lower portions of the sliding faces and the support face adjacent thereto define recesses in the support elements and the recesses have an abutment engaging the support wall for the feed hose.

* * * * *